US005669229A

United States Patent [19]

Ohbayashi et al.

[11] Patent Number: 5,669,229

[45] Date of Patent: Sep. 23, 1997

[54] CEILING-MOUNTED TYPE AIR CONDITIONER

[75] Inventors: Kazumi Ohbayashi; Susumu Yamashita; Masami Ito, all of Aichi-ken; Kenji Matsuda, Nagoya; Shin Watabe, Nagoya; Mitsuru Nakamura, Nagoya, all of Japan

[73] Assignee: Mitsubishi Jukogyo Kabushiki Kaisha, Tokyo, Japan

[21] Appl. No.: 633,122

[22] Filed: Apr. 16, 1996

[30] Foreign Application Priority Data

| | | | |
|---|---|---|---|
| May 30, 1995 | [JP] | Japan | 7-155295 |
| Jun. 1, 1995 | [JP] | Japan | 7-158670 |
| Jun. 1, 1995 | [JP] | Japan | 7-158671 |

[51] Int. Cl.[6] ..... F25D 23/12; F24F 1/00

[52] U.S. Cl. ..... 62/259.1; 62/262; 62/DIG. 16; 165/53; 165/122

[58] Field of Search ..... 62/259.1, DIG. 16, 62/262; 165/53, 122; 454/906

[56] References Cited

U.S. PATENT DOCUMENTS

| | | | |
|---|---|---|---|
| 4,898,003 | 2/1990 | Ichikawa et al. | 165/122 X |
| 4,958,504 | 9/1990 | Ichikawa et al. | 62/259.1 X |
| 5,211,219 | 5/1993 | Kawabata et al. | 165/122 |
| 5,417,279 | 5/1995 | Wada | 165/122 |

FOREIGN PATENT DOCUMENTS

| | | | |
|---|---|---|---|
| 0547450 | 6/1993 | European Pat. Off. | 165/122 |
| 0062529 | 4/1985 | Japan | 62/262 |
| 0178232 | 9/1985 | Japan | 165/53 |
| 0128038 | 6/1986 | Japan | 165/122 |
| 1280329 | 12/1986 | Japan | 454/906 |
| 0298738 | 12/1990 | Japan | 62/DIG. 16 |
| 0143723 | 6/1991 | Japan | 62/DIG. 16 |
| 0181722 | 8/1991 | Japan | 165/53 |
| 4036519 | 2/1992 | Japan | 165/53 |
| 4103512 | 9/1992 | Japan | 165/122 |
| 5113230 | 5/1993 | Japan | 62/259.1 |
| 6034153 | 2/1994 | Japan | 62/259.1 |

*Primary Examiner*—Christopher Kilner
*Attorney, Agent, or Firm*—Fish & Richardson P.C.

[57] ABSTRACT

An object of the present invention is to make a housing for a ceiling-mounted type air conditioner small-sized without decreasing the performance and capacity of the air conditioner, and particularly to decrease the length of the housing in the depth direction, thereby facilitating the installation of the air conditioner and improving the room appearance. To achieve the above object, a heat exchanger is bent into a doglegged shape, the bent portion thereof is convex to the air inlet side, and the heat exchanger is inclined so as to be raised on the air inlet side. A cross flow fan rotating around a horizontal axis is disposed on the downstream side of the heat exchanger.

9 Claims, 2 Drawing Sheets

CEILING-MOUNTED TYPE AIR CONDITIONER

FIELD OF THE INVENTION AND RELATED ART STATEMENT

The present invention relates to a ceiling-mounted type air conditioner.

One example of conventional ceiling-mounted type air conditioners is shown in FIG. 3.

An air inlet 04 is formed in rear of a lower face 03A of a housing 03 hung from a ceiling 01 by means of hanging bolts 02, and an air outlet 05 is formed in front of the housing 03.

In this specification, "front" means the left on the drawing, and "rear" means the right on the drawing.

In the housing 03, an air flow passage 06 extending from the air inlet 04 to the air outlet 05 is formed. This air flow passage 06 is furnished with a sirocco fan 07 and a heat exchanger 08 which is disposed on the downstream side of the fan 07 in an inclined manner so as to rise toward the front.

A drain pan 09 is disposed under the heat exchanger 08, an inlet grille 010 is installed at the air inlet 04, and louvers 011 are installed at the air outlet 05. Reference numeral 012 denotes a side wall.

During the operation of the air conditioner, a refrigerant supplied from an outdoor unit (not shown) circulates in a tube in the heat exchanger 08, and a rotor 07A in the sirocco fan 07 rotates in the direction of arrow a.

Thereupon, room air, which, passing through the inlet grille 010, enters the air flow passage 06 through the air inlet 04, is sucked into a fan casing 07B of the sirocco fan 07 through openings at both ends, energized by the rotor 07A, and discharged through a discharge port 07C.

Then, this air is cooled or heated by heat exchange with the refrigerant flowing in the tube in a process of flowing between fins of the heat exchanger 08, and thereafter is blown into a room by being guided by the blowout louvers 011 installed at the air outlet 05.

In recent years, air conditioners of this type have been required to be small-sized. Although various measures have been taken to meet this requirement, it is difficult to make the air conditioner further small-sized.

In the above-described conventional air conditioner, the heat exchanger 08 in the housing 3 cannot be exposed to the outside easily, which presents a problem in that manpower and time are required for the cleaning of the heat exchanger 08.

In addition, the conventional air conditioner has a problem in that the housing 03 is high and the pressure loss of the room air passing through the air flow passage 06 is high.

OBJECT AND SUMMARY OF THE INVENTION

An object of the present invention is to make a housing for an air conditioner small-sized without decreasing the performance and capacity of the air conditioner, and particularly to decrease the length of the housing in the depth direction.

Another object of the present invention is to omit an inlet grille by decreasing a suction space and an air inlet.

Still another object of the present invention is to enhance the aerodynamic performance at the air inlet.

A further object of the present invention is to expose a heat exchanger easily to facilitate the cleaning thereof.

It is also one object of the present invention to reduce the pressure loss of air passing through an air flow passage.

A still further object of the present invention is to reduce noise diffused from the air conditioner to a minimum.

The present invention was made to solve the above problems. Accordingly, the present invention provides a ceiling-mounted type air conditioner in which an air inlet is provided in rear of a lower part of a housing hung from a ceiling and an air outlet is provided in front of the housing; a heat exchanger and a fan are installed in an air flow passage which is formed in the housing and extends from the air inlet to the air outlet; and room air sucked by the fan through the air inlet, being cooled or heated by the heat exchanger, is blown into a room through the air outlet, wherein the heat exchanger is bent into a doglegged shape, the bent portion thereof is convex to the air inlet side, the heat exchanger is inclined so as to be raised on the air inlet side, and a cross flow fan rotating around a horizontal axis is disposed on the downstream side of the heat exchanger.

Preferably, an air inlet without the need for an inlet grille is formed between the lower end of a rear panel of the housing and the rear end of a lower panel of the housing.

Preferably, an air filter is installed in an inclined manner along the heat exchanger between the air inlet and the heat exchanger.

Preferably, the lower end of the rear panel of the housing is curved outward smoothly.

Also, the present invention provides a ceiling-mounted type air conditioner in which an air inlet is provided in rear of a lower part of a housing hung from a ceiling and an air outlet is provided in front of the housing; a heat exchanger and a fan are installed in an air flow passage which is formed in the housing and extends from the air inlet to the air outlet; and room air sucked by the fan through the air inlet, being cooled or heated by the heat exchanger, is blown into a room through the air outlet, wherein the heat exchanger is bent into a doglegged shape, the bent portion thereof is convex to the air inlet side, the heat exchanger is inclined so as to be raised on the air inlet side, a cross flow fan rotating around a horizontal axis is disposed on the downstream side of the heat exchanger, and a drain pan, which is also used as a lower panel of the housing, is installed under the heat exchanger so as to be capable of being detached from the housing.

Preferably, a stabilizer for the cross flow fan is integrally formed in front of the drain pan.

Preferably, the air inlet is formed between the rear end of the drain pan and the lower end of the rear panel of the housing, and the rear end of the drain pan is curved smoothly so as to be convex upward.

Further, the present invention provides a ceiling-mounted type air conditioner wherein of a fan case for the cross flow fan, at least a portion where the gap between the fan case and the cross flow fan is narrowest is made of a porous sound absorbing material, and an air layer is formed on the back side of the porous sound absorbing material.

Preferably, the air layer is formed between the back surface of the porous sound absorbing material and an upper panel of the housing.

Preferably, a concave portion is provided on the back surface of the porous sound absorbing material, and the air layer is formed by a space portion formed by bringing both sides of the concave portion into contact with the lower surface of the upper panel.

In the present invention, the room air is sucked into the air flow passage through the air inlet, cooled or heated in a process of passing through the heat exchanger bent into a doglegged shape, energized by the cross flow fan, and thereafter blown into the room through the air outlet.

In the air conditioner of the present invention, when the air conditioner is operated, the room air, entering the air flow passage through the air inlet, is cooled or heated in a process of passing through the heat exchanger, and thereafter energized by the cross flow fan and blown into the room through the air outlet.

By removing the drain pan, which is also used as the lower panel, the heat exchanger is exposed.

In the air conditioner of the present invention, the noise produced, during the operation of the cross flow fan, at the portion where the gap between the cross flow fan and the fan case is narrowest is damped by the porous sound absorbing material and the air layer.

According to a preferred embodiment of the present invention, there is provided a ceiling-mounted type air conditioner in which an air inlet is provided in rear of a lower part of a housing hung from a ceiling and an air outlet is provided in front of the housing; a heat exchanger and a fan are installed in an air flow passage which is formed in the housing and extends from the air inlet to the air outlet; and room air sucked by the fan through the air inlet, being cooled or heated by the heat exchanger, is blown into a room through the air outlet, wherein the heat exchanger is inclined so as to be raised on the air inlet side, a cross flow fan rotating around a horizontal axis is disposed on the downstream side of the heat exchanger, and a drain pan, which is also used as a lower panel of the housing, is installed under the heat exchanger so as to be capable of being detached from the housing.

Also, according to another preferred embodiment of the present invention, there is provided a ceiling-mounted type air conditioner in which an air inlet is provided in rear of a lower part of a housing hung from a ceiling and an air outlet is provided in front of the housing; a heat exchanger is installed so as to be inclined in such a manner as to be raised on the air inlet side; a cross flow fan rotating around a horizontal axis is disposed on the downstream side of the heat exchanger; and room air sucked by the cross flow fan through the air inlet, being cooled or heated by the heat exchanger, is blown into a room through the air outlet, wherein of a fan case for the cross flow fan, at least a portion where the gap between the fan case and the cross flow fan is narrowest is made of a porous sound absorbing material, and an air layer is formed on the back side of the porous sound absorbing material.

DETAILED DESCRIPTION OF PREFERRED EMBODIMENTS

Figure 1:
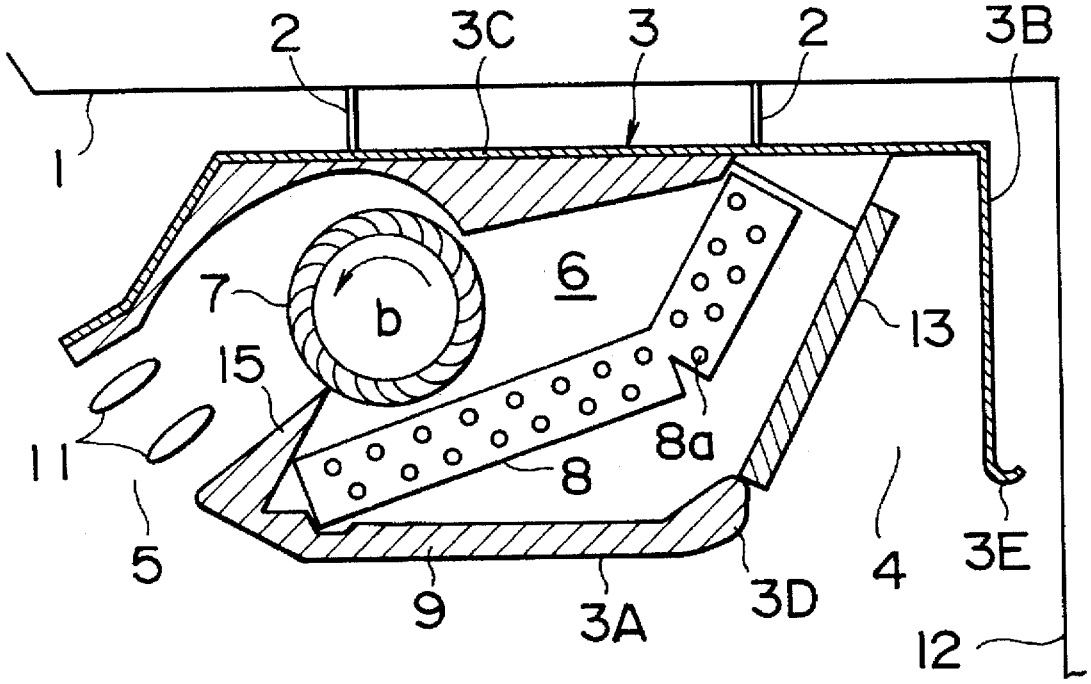
FIG. 1 is a schematic longitudinal sectional view of an air conditioner in accordance with a first embodiment of the present invention.

FIG. 1 shows an air conditioner in accordance with a first embodiment of the present invention.

A housing 3 is hung from a ceiling 1 by means of hanging bolts 2. An air inlet 4 is formed in rear of a lower part of the housing 3, and an air outlet 5 is formed in front of the housing 3.

In the housing 3, an air flow passage 6 extending from the air inlet 4 to the air outlet 5 is formed. This air flow passage 6 is furnished with a heat exchanger 8 and a cross flow fan 7 which is disposed on the downstream side of the heat exchanger 8 so as to rotate around a horizontal axis.

A drain pan 9, which is also used as a lower panel 3A of the housing 3, is disposed under the heat exchanger 8. In front of the drain pan 9, a stabilizer 15 for the cross flow fan 7 is formed integrally with the drain pan 9. The rear end 3D of the drain pan 9 is curved smoothly so as to be convex upward. The air inlet 4 is disposed between the rear end 3D and the lower end 3E of a rear panel 3B of the housing 3. The drain pan 9 is detachably attached to the housing 3. It can be detached from the housing 3 by using an ordinary tool.

The heat exchanger 8 is bent into a doglegged shape. The bent portion of the heat exchanger 8 is convex to the air inlet 4 side, and the heat exchanger 8 is inclined so as to be raised on the air inlet 4 side. An air filter 13 is installed in an inclined manner along the heat exchanger 8 between the heat exchanger 8 and the air inlet 4. Reference numerals 11 and 12 denote louvers installed at the air outlet 5 and a side wall, respectively.

During the operation of the air conditioner, a refrigerant supplied from an outdoor unit (not shown) circulates in a tube **8*a* in the heat exchanger 8, and a cross flow fan 7** rotates in the direction of arrow b.

Thereupon, room air enters the air flow passage 6 through the air inlet 4, and dust contained in the room air is trapped by the air filter 13 in a process of flowing through the air filter 13.

Then, this air is cooled or heated by heat exchange with the refrigerant flowing in the tube **8*a* in a process of flowing between fins of the heat exchanger 8**.

The air is sucked and energized by the cross flow fan 7, and thereafter is blown into a room through the air outlet 5 while the blowout direction is regulated by the blowout louver 11.

In this air conditioner, the heat exchanger 8 is bent into a doglegged shape, the bent portion thereof is convex to the air inlet 4 side, and the heat exchanger 8 is inclined so as to be raised on the air inlet 4 side. Therefore, the length of the heat exchanger 8 in the depth direction (the right and left direction in the drawing) can be shortened without decreasing the air flow passage area of the heat exchanger 8. Accordingly, the length of the drain pan 9 in the depth direction can be decreased.

Figure 3:
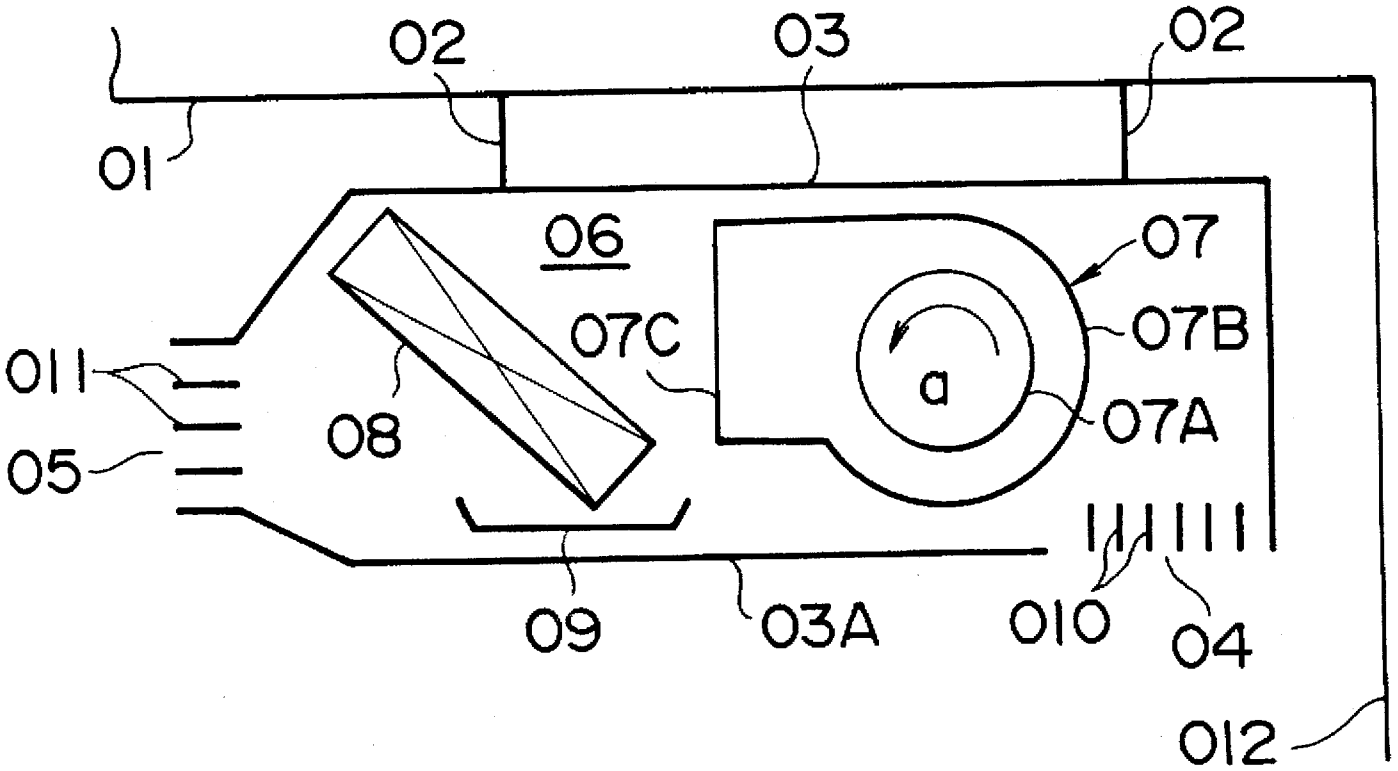
FIG. 3 PRIOR ART
FIG. 3 is a longitudinal sectional view of a conventional ceiling-mounted type air conditioner.

Also, since the cross flow fan 7 rotating around a horizontal axis is used, the fan case 07B necessary for the conventional sirocco fan 07 as shown FIG. 3 is not required. Therefore, a predetermined distance is not needed between the discharge port 07C of the fan case 07B and the heat exchanger 08, so that the cross flow fan 7 can be installed above the front end of the heat exchanger 8. Thereupon, the length of an installation space for the cross flow fan 7 in the depth direction can be decreased significantly as compared with the conventional air conditioner.

Further, since the cross flow fan 7 is disposed on the downstream side of the heat exchanger 8 bent into a doglegged shape, the length of a suction space in the depth direction can be decreased significantly as compared with the conventional air conditioner. Accordingly, the length of the air inlet 4 in the depth direction can be shortened, and the air filter 13 is disposed in an inclined manner along the heat exchanger 8 between the air inlet 4 and the heat exchanger 8. Therefore, the need for preventing bad appearance by using any means is eliminated though the inlet grille 010 is installed at the air inlet 04 in the conventional air conditioner.

The rear end 3D of the lower panel 3A of the housing 3 is formed into a smooth arcuate surface, and the lower end 3E of the rear panel 3B of the housing 3 is curved outward smoothly. When the air inlet 4 is formed in such a manner, the room air can be sucked smoothly into the air flow passage 6 through the air inlet 4, so that the aerodynamic performance can be enhanced.

The lower panel 3A and an upper panel 3C of the housing 3 are made of a sound absorbing material, and the inside surfaces of these panels are shaped so as to be suitable to the fan case for the cross flow fan 7, by which the aerodynamic performance of the cross flow fan 7 can be enhanced, and the noise thereof can be reduced.

In this air conditioner, the heat exchanger 8 is inclined so as to be raised on the air inlet 4 side, and the cross flow fan 7 rotating around a horizontal axis is disposed above the front end of the heat exchanger 8. Therefore, the height of the housing 3 can be decreased as compared with the conventional air conditioner.

By removing the drain pan 9, which is also used as the lower panel, from the housing 3, the upstream side of the heat exchanger 8, that is, the entire surface of the heat exchanger 8 on the air inlet side is exposed downward. Therefore, the heat exchanger 8 can be cleaned easily and rapidly with the housing 3 being hung from the ceiling 1.

The rear end 3D of the drain pan 9 is curved smoothly so as to be convex upward, and the air inlet 4 is formed between the rear end 3D of the drain pan 9 and the lower end 3E of the rear panel 3B, so that the contraction of the room air at the air inlet 4 can be reduced. Thereupon, the pressure loss of the room air can be reduced, and a large quantity of room air can be sucked smoothly into the air flow passage 6.

The sucked room air is introduced to the vicinity of the drain pan 9 along the smoothly curved surface at the rear end 3D of the drain pan 9 by the Coanda effect, so that the quantity of air flowing into a lower, greatly inclined portion of the heat exchanger 8 bent into a doglegged shape is large. Therefore, the heat exchange performance at this portion can be delivered fully.

When a stabilizer 15 is integrally formed in front of the drain pan 9, the quantity of air flowing through the front end of the heat exchanger 8 can be increased. In addition, the number of parts is reduced, so that the cost of the stabilizer 15 and the assembly manpower therefor can be reduced. Further, when the drain pan 9 is removed, the cross flow fan 7 can be cleaned easily.

Figure 2:
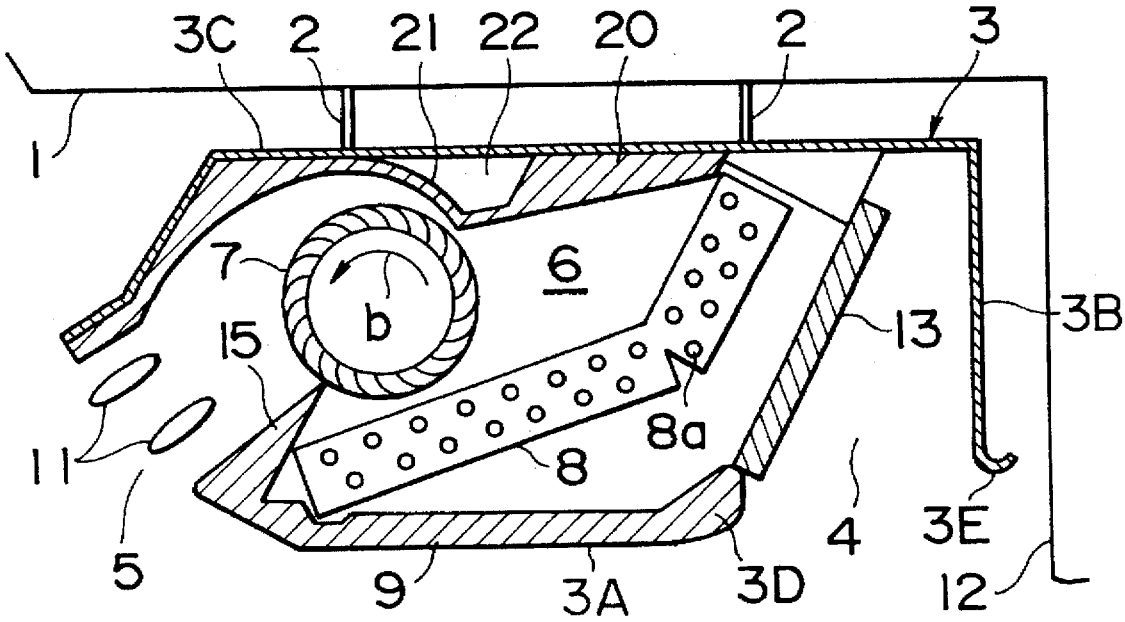
FIG. 2 is a schematic longitudinal sectional view of an air conditioner in accordance with a second embodiment of the present invention.

FIG. 2 shows an air conditioner in accordance with a second embodiment of the present invention.

A fan case 20 for the cross flow fan 7 is made of a porous sound absorbing material. A concave portion 21 is provided on the back surface of a portion where the gap between the fan case 20 and the cross flow fan 7 is narrowest, and an air layer 22 is formed by a space portion formed by bringing both sides of the concave portion 21 into contact with the lower surface of the upper panel 3C of the housing 3.

Other construction is the same as that shown in FIG. 1, and the same reference numerals are applied to the corresponding parts.

In the air conditioner in accordance with the first embodiment, described above, when the cross flow fan 7 rotates during the operation of air conditioner, noise is sometimes produced at a portion where the gap between the cross flow fan 7 and the fan case 20 is narrow, and the noise is diffused in the room through the air inlet 4 and the air outlet 5.

In the second embodiment, when the cross flow fan 7 rotates, noise is produced at a portion where the gap between the cross flow fan 7 and the fan case 20 is narrowest. However, the noise is damped in a process of passing through many pores in the porous sound absorbing material, and further damped by expansion when entering the air layer 22.

In the embodiment shown in FIG. 2, the whole of the fan case 20 is made of a porous sound absorbing material. Alternatively, only the portion where the gap between the cross flow fan 7 and the fan case 20 is narrowest may be made of a porous sound absorbing material.

Also, if the drain pan 9 is made of a sound absorbing material, the noise can be reduced further.

In the present invention, the heat exchanger is bent into a doglegged shape, the bent portion thereof is convex to the air inlet side, the heat exchanger is inclined so as to be raised on the air inlet side, and the cross flow fan rotating around a horizontal axis is installed on the downstream side of the heat exchanger. Therefore, the length of the heat exchanger in the depth direction, the length of the installation space for the cross flow fan in the depth direction, and the lengths of the suction space and the air inlet in the depth direction can be decreased. Thereby, the length of the housing in the depth direction can be shortened greatly as compared with the conventional air conditioner, so that the installation space for the housing is reduced, thereby improving the room appearance.

Since the air inlet is formed between the lower end of the rear panel of the housing and the rear end of the lower panel of the housing, the inlet grille is not needed, so that the cost thereof can be saved.

Since the air filter is installed in an inclined manner along the heat exchanger between the air inlet and the heat exchanger, the air filter can be installed easily, and dust contained in the room air can be trapped by the air filter.

Since the lower end of the rear panel of the housing is curved outward smoothly, the aerodynamic performance of the air inlet can be enhanced, so that the room air can be sucked smoothly into the air flow passage.

Also, in the present invention, since the heat exchanger is inclined so as to be raised on the air inlet side, and the cross flow fan rotating around a horizontal axis is installed on the downstream side of the heat exchanger, the height of the housing can be reduced.

Further, by removing the drain pan, which is also used as the lower panel, from the housing, the heat exchanger can be exposed downward with the housing being hung from the ceiling. Therefore, the heat exchanger can be cleaned easily and rapidly.

The rear end of the drain pan is curved smoothly so as to be convex upward, and the air inlet is formed between the rear end of the drain pan and the lower end of the rear panel. Therefore, the contraction of the room air at the air inlet can be reduced, so that the pressure loss of the room air can be reduced and a large quantity of room air can be sucked smoothly into the air flow passage.

The room air is introduced to the vicinity of the drain pan along the smoothly curved surface at the rear end of the drain pan by the Coanda effect, so that the quantity of air flowing into the heat exchanger is large. Therefore, the heat exchange performance of the heat exchanger can be delivered fully.

When the stabilizer is integrally formed in front of the drain pan, the quantity of air flowing through the front end of the heat exchanger can be increased. In addition, the number of parts is reduced, so that the cost of the stabilizer and the assembly manpower therefor can be reduced. Further, when the drain pan, which is also used as the lower panel, is removed from the housing, the cross flow fan can be cleaned easily.

Further in the present invention, the noise produced, during the operation of the cross flow fan, at the portion where the gap between the cross flow fan and the fan case is narrowest is damped by the porous sound absorbing material and the air layer, so that the noise diffused into the room can be reduced.

Since the concave portion is provided on the back surface of the porous sound absorbing material, and the air layer is formed by a space portion formed by bringing both sides of the concave portion into contact with the lower surface of the upper panel of the housing, the air layer can be formed easily at a low cost.

We claim:

1. A ceiling-mounted type air conditioner in which an air inlet is provided in the rear of a lower part of a housing hung from a ceiling and an air outlet is provided in the front of said housing; a heat exchanger and a fan are installed in an air flow passage which is formed in said housing and extends from said air inlet to said air outlet; and room air sucked by said fan through said air inlet, being cooled or heated by said heat exchanger, is blown into a room through said air outlet, wherein said heat exchanger is bent into a doglegged shape, said heat exchanger is composed of a section extending slantingly along a lower panel of said housing and a section rising slantingly along a rear panel of said housing, the bent portion thereof is convex to the air inlet side, said heat exchanger is inclined so as to be raised on the air inlet side, a cross flow fan rotating around a horizontal axis is disposed downstream of said heat exchanger, and an air filter extends slantingly on the air inlet side so as to be substantially parallel with the section of said heat exchanger rising slantingly.

2. A ceiling-mounted type air conditioner according to claim 1, wherein an air inlet without the need for an inlet grille is formed between the lower end of a rear panel of said housing and the rear end of a lower panel of said housing.

3. A ceiling-mounted type air conditioner according to claim 1, wherein the lower end of the rear panel of said housing is curved outward smoothly.

4. A ceiling-mounted type air conditioner in which an air inlet is provided in rear of a lower part of a housing hung from a ceiling and an air outlet is provided in front of said housing; a heat exchanger and a fan are installed in an air flow passage which is formed in said housing and extends from said air inlet to said air outlet; and room air sucked by said fan through said air inlet, being cooled or heated by said heat exchanger, is blown into a room through said air outlet, wherein said heat exchanger is bent into a doglegged shape, the bent portion thereof is convex to the air inlet side, said heat exchanger is inclined so as to be raised on the air inlet side, a cross flow fan rotating around a horizontal axis is disposed on the downstream side of said heat exchanger, and a drain pan, which is also used as a lower panel of said housing, is installed under said heat exchanger so as to be capable of being detached from said housing.

5. A ceiling-mounted type air conditioner according to claim 4, wherein a stabilizer for said cross flow fan is integrally formed in front of said drain pan.

6. A ceiling-mounted type air conditioner according to claim 4, wherein said air inlet is formed between the rear end of said drain pan and the lower end of the rear panel of said housing, and the rear end of said drain pan is curved smoothly so as to be convex upward.

7. A ceiling-mounted type air conditioner according to claims 1 and 4, wherein of a fan case for said cross flow fan, at least a portion where the gap between said fan case and said cross flow fan is narrowest is made of a porous sound absorbing material, and an air layer is formed on the back side of said porous sound absorbing material.

8. A ceiling-mounted type air conditioner according to claim 7, wherein said air layer is formed between the back surface of said porous sound absorbing material and an upper panel of said housing.

9. A ceiling-mounted type air conditioner according to claim 8, wherein a concave portion is provided on the back surface of said porous sound absorbing material, and said air layer is formed by a space portion formed by bringing both sides of said concave portion into contact with the lower surface of said upper panel.

* * * * *